US008251215B2

(12) United States Patent
Lin

(10) Patent No.: US 8,251,215 B2
(45) Date of Patent: Aug. 28, 2012

(54) INFLATABLE DEVICE WITH AIR BAG AND A PACKAGING METHOD BY USING THE SAME

(76) Inventor: Pi-Fen Lin, Keelung (TW)

( * ) Notice: Subject to any disclaimer, the term of this patent is extended or adjusted under 35 U.S.C. 154(b) by 397 days.

(21) Appl. No.: 12/545,821

(22) Filed: Aug. 22, 2009

(65) Prior Publication Data

US 2011/0041462 A1 Feb. 24, 2011

(51) Int. Cl.
*B65D 81/02* (2006.01)

(52) U.S. Cl. ..... 206/522; 383/3

(58) Field of Classification Search ..... 206/521, 206/522, 591–594; 383/3
See application file for complete search history.

(56) References Cited

U.S. PATENT DOCUMENTS 4,468,810 A * 8/1984 Longo ..... 383/3
4,671,393 A * 6/1987 Rainey ..... 383/4
5,217,131 A * 6/1993 Andrews ..... 206/522
5,833,069 A * 11/1998 Jones ..... 206/522
6,334,537 B1 * 1/2002 Tepper ..... 206/522
2003/0052035 A1 * 3/2003 Dickinson ..... 206/522
2007/0053615 A1 * 3/2007 Liu et al. ..... 383/3
2008/0011639 A1 * 1/2008 Liu ..... 206/522
2009/0032429 A1 * 2/2009 Morris et al. ..... 206/522

* cited by examiner

*Primary Examiner* — Luan K Bui

(74) *Attorney, Agent, or Firm* — Fai Patent & Trademark Law Firm; Chao-Chang David Fai

(57) ABSTRACT

An inflatable device with air bag includes an air bag, two first assembly portions and two second assembly portions. The two first assembly portions are respectively fastened at two sides of the air bag, and the two second assembly portions are respectively fastened at another two sides of the air bag. The two second assembly portions correspond to the two first assembly portions. Thereby, by utilizing the assembly portions to repeatedly assemble the air bags, the dimension of the inflatable device with air bag is quickly expanded to a proper size to wrap the objects with different sizes. It prevents the object from being impacted, and achieves the waterproof effect and the moisture-proof effect. A packaging method by using the inflatable device with air bag is also disclosed.

5 Claims, 10 Drawing Sheets

INFLATABLE DEVICE WITH AIR BAG AND A PACKAGING METHOD BY USING THE SAME

BACKGROUND OF THE INVENTION

1. Field of the Invention

The present invention relates to an inflatable device with air bag and a packaging method by using the same. In particular, the present invention relates to a protection device for wrapping an object that has impact-proof, waterproof, and moisture-proof effects.

2. Description of Related Art

When expensive or dedicate objects are shipped or moved, an external package box is used for receiving the object. In the package box, a plurality of air bags is placed in the package box to fix the object. It has the shock-reducing and pressure-proof effects to prevent the object from being damaged due to impact or press by external force.

However, the inflatable device with air bag of the prior art is placed in the package box. The dimension of the package box has to meet the size of the object. It is inconvenient for the user. Moreover, the dimension of the package box is fixed. It is inconvenient to catty the package box, and the receiving space for it is big.

SUMMARY OF THE INVENTION

One particular aspect of the present invention is to provide an inflatable device with air bag and a packaging method by using the inflatable device with air bag. The air bags can be serially assembled by utilizing the assembly portions to rapidly form the inflatable device with air bag with a proper size for wrapping an object with different sizes. It has the impact-proof, waterproof, and moisture-proof effects.

The inflatable device with air bag includes an air bag, two first assembly portions respectively fastened at two sides of the air bag, and two second assembly portions respectively fastened at another two sides of the air bag. The two second assembly portions correspond to the two first assembly portions.

The present invention also provides an inflatable device with air bag that has a plurality of air bags. Each of the air bags is assembled with another air bag and can be disassembled. The air bags form an enclosed space.

The present invention provides a packaging method by using an inflatable device with air bag, and includes the following steps. An inflatable device with a plurality of air bags is provided. Each of two sides of the air bag respectively is fastened with a first assembly portion. Another two sides of the air bag respectively are fastened with a second assembly portion. The air bags are assembled to form an air bag with larger dimension and can be disassembled. The first assembly portion and the second assembly portion of the assembled air bag are assembled to form an enclosed space. An object is wrapped in the inflatable device with air bag.

The present invention also provides a packaging method by using an inflatable device with air bag, and includes the following steps. An inflatable device with a plurality of air bags is provided. Each of two sides of the air bag respectively is fastened with a first assembly portion. Another two sides of the air bag respectively are fastened with a second assembly portion. The air bags are assembled to form an air bag with larger dimension and can be disassembled. Another inflatable device with a plurality of air bags is provided. The air bags are assembled to form an air bag with larger dimension and can be disassembled. The assembly air bag of the inflatable device with a plurality of air bags is assembled with the assembly air bag of another inflatable device with a plurality of air bags. The two assembled inflatable devices with a plurality of air bags form an enclosed space. An object is wrapped in the inflatable device with air bag.

The present invention has the following characteristics.

1. According to dimension of the object, the first assembly portion and the second assembly portion can be serially and repeatedly assembled to expand the inflatable device with air bag with a proper dimension. The air bag that wraps an object has a good buffer effect and a shock-absorb effect to achieve the impact-proof, waterproof, and moisture-proof effects.

2. The first assembly portion and the second assembly portion can be rapidly disassembled so that the expanded air bag can be easily received and carried. The required space is reduced.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
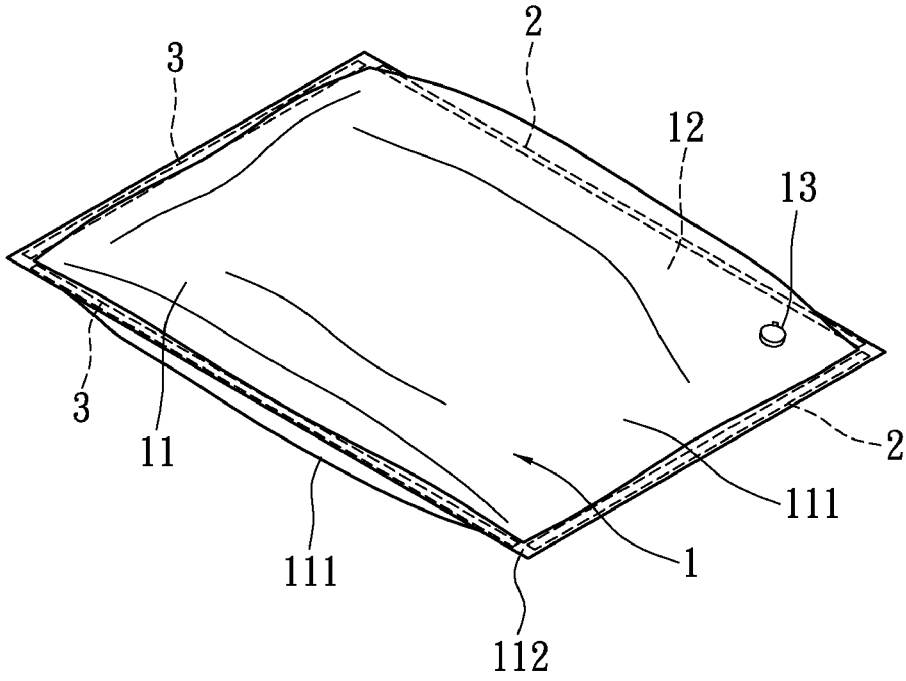
FIG. 1 is a perspective view of the inflatable device with air bag of the present invention.

Reference is made to FIG. 1. The inflatable device with air bag comprises at least one air bag 1, at least two first assembly portions 2 and at least two second assembly portions 3.

The air bag 1 is made of flexible materials. The air bag 1 has a main body 11, an air room 12 and an air-inlet opening 13. The main body 11 is formed by two flaked bodies 111 that are combined together. The edges of the two flaked bodies 111 are fastened to form a fastening portion 112 and the air room 12. The air room 12 in the main body 11 is separated from external environment. The air-inlet opening 13 is located on the surface of the main body 11, and the air-inlet opening 13 links the air room 12 with external environment. Air in the external environment can enters into the air room 12 via the air-inlet opening 13 to be filled in the main body 11. However, air in the external environment is blown into the air-inlet opening 13 by mouth or an air pump (not shown in the figure). Thereby, the quantity of air filled into the main body 11 determines the inflatable degree of the air bag 1. Due to the flexibility of air, the surface of the air bag is soft to provide the shock-releasing effect and the pressure-proof effect.

The first assembly portion 2 can be assembled with the second assembly portion 3. The first assembly portions 2 and the second assembly portions 3 are fastened on the fastening portion 112 of the air bag 1. The first assembly portion 2 and the second assembly portion 3 are symmetrically located at the edge of the air bag 1 so that the air bag 1 can be assembled with another air nag 1 to become an air bag 1 with larger dimension. For example, the two first assembly portions 2 are respectively located at the upper edge and the left edge of the air bag 1, and the two second assembly portions 3 are respectively located at the lower edge and the right edge of the air bag 1.

Figure 2:
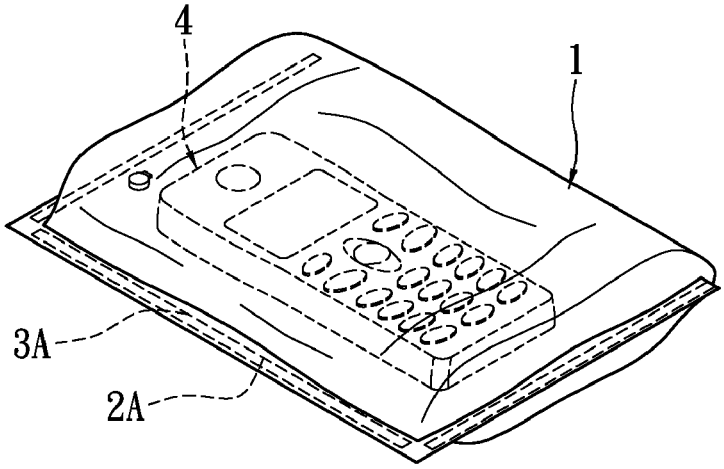
FIG. 2 is a schematic diagram of the inflatable device with air bag of the first embodiment of the present invention.
Figure 3:
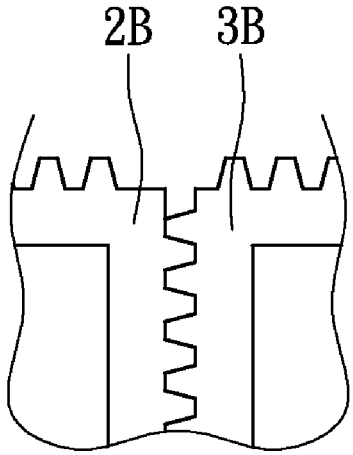
FIG. 3 is a schematic diagram of the first assembly portion assembled with the second assembly portion of the present invention.
Figure 4:
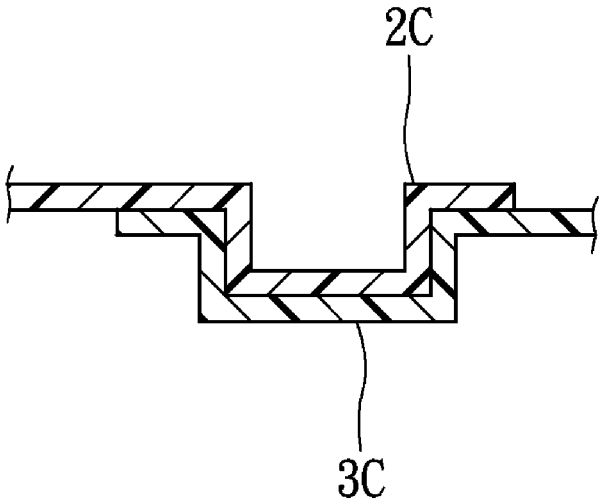
FIG. 4 is another schematic diagram of the first assembly portion assembled with the second assembly portion of the present invention.
Figure 5:
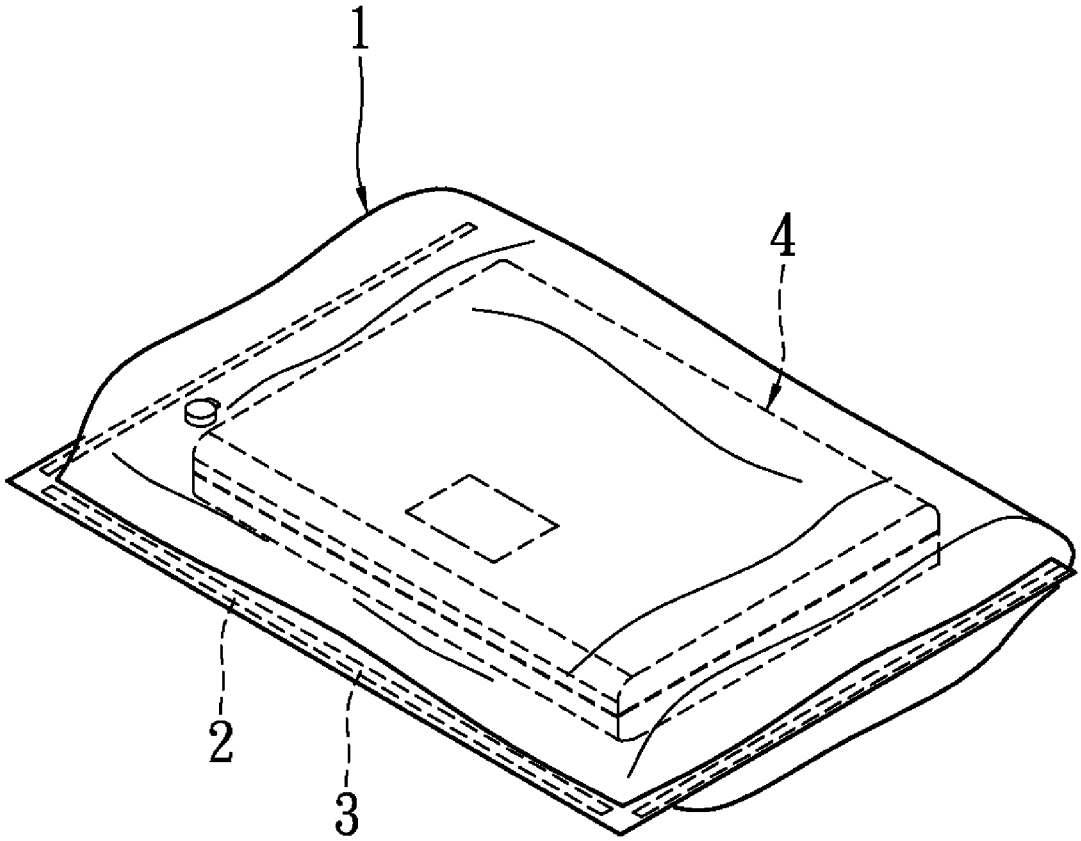
FIG. 5 is another schematic diagram of the inflatable device with air bag of the first embodiment of the present invention.
Figure 6:
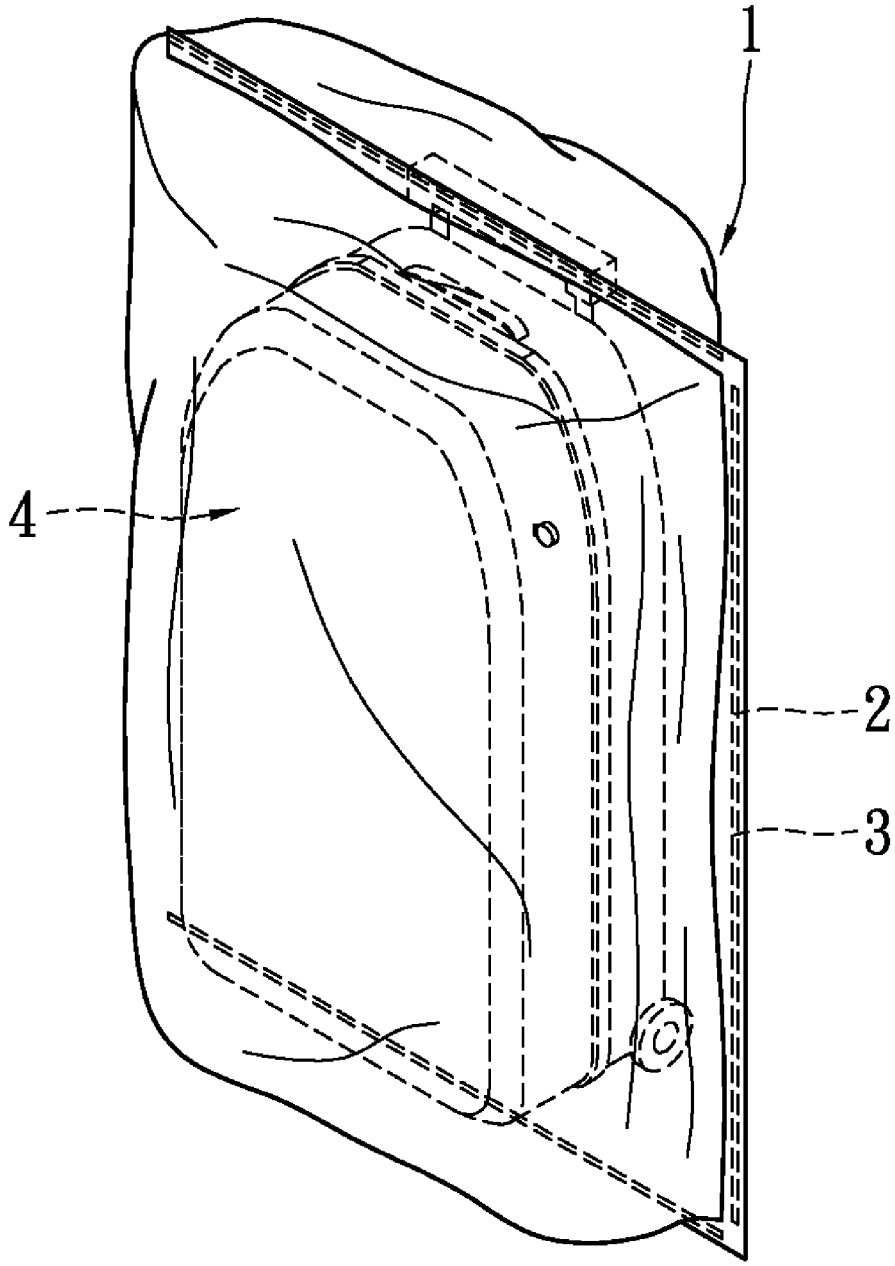
FIG. 6 is a further schematic diagram of the inflatable device with air bag of the first embodiment of the present invention.

The air bag 1 is used for wrapping an object (such as cell phone, PDA, walkman, laptop or baggage). The first assembly portion 2 is assembled with the second assembly portion 3 so that the object is stably placed in the air bag and it can prevent the object from impacted or pressed. In the first embodiment, the air bag 1 is folded by half and the first assembly portion 2 is assembled with the second assembly portion 3. The first assembly portion 2 and the second assembly portion 3 can be designed with different types. For example, the first assembly portion 2 and the second assembly portion 3 are respectively designed as a Velcro hook surface 2A and a Velcro loop surface 2B (referring to FIG. 2). When the inflatable device with air bag wraps the object 4, the Velcro hook surface 2A located at the upper edge of the air bag 1 is assembled with the Velcro loop surface 2B located at the lower edge of the air bag 1. Alternatively, the Velcro hook surface 2A located at the left edge of the air bag 1 is assembled with the Velcro loop surface 2B located at the lower right of the air bag 1 for preventing the object 4 wrapped in the inflatable device with air bag from being impacted or pressed. Moreover, the first assembly portion 2 and the second assembly portion 3 can be designed as a first zipper 2B and a second zipper 3B (referring to FIG. 3). By utilizing the zipper head (not shown in the figure), the first zipper 2B is assembled with the second zipper 3B to achieve the same effect. Furthermore, the first assembly portion 2 and the second assembly portion 3 can be designed as a convex portion 2C and a concave trough 3C (referring to FIG. 4). The convex portion 2C is wedged with the concave trough 3C to achieve the same effect. However, the size of the air bag 1 can be changed according to the requirements. Reference is made to FIGS. 5 and 6. The air bag 1 can wrap the laptop or baggage with a larger dimension to prevent the object 4 from being impacted or pressed.

Figure 7:
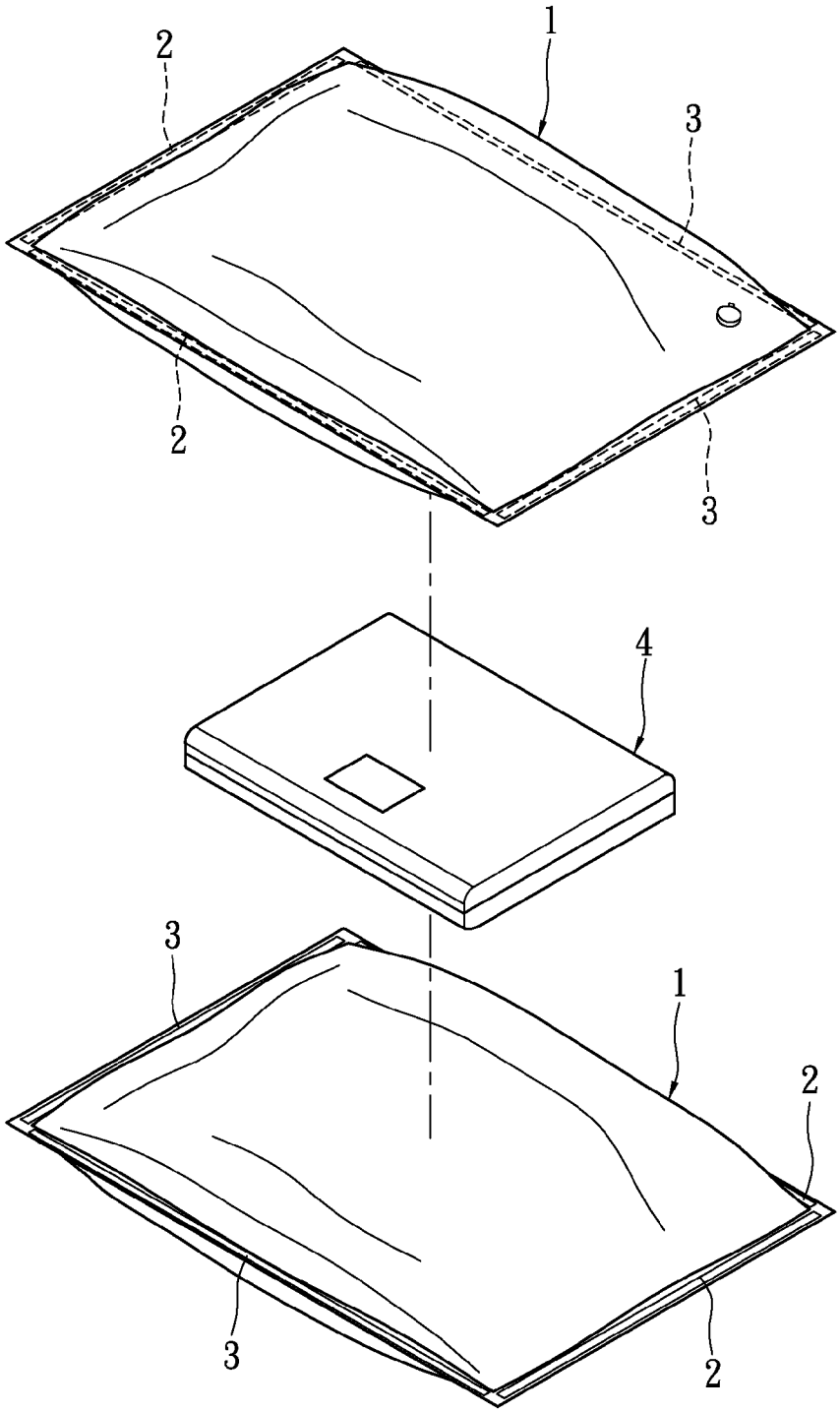
FIG. 7 is a schematic diagram of the inflatable device with air bag of the second embodiment of the present invention.
Figure 8:
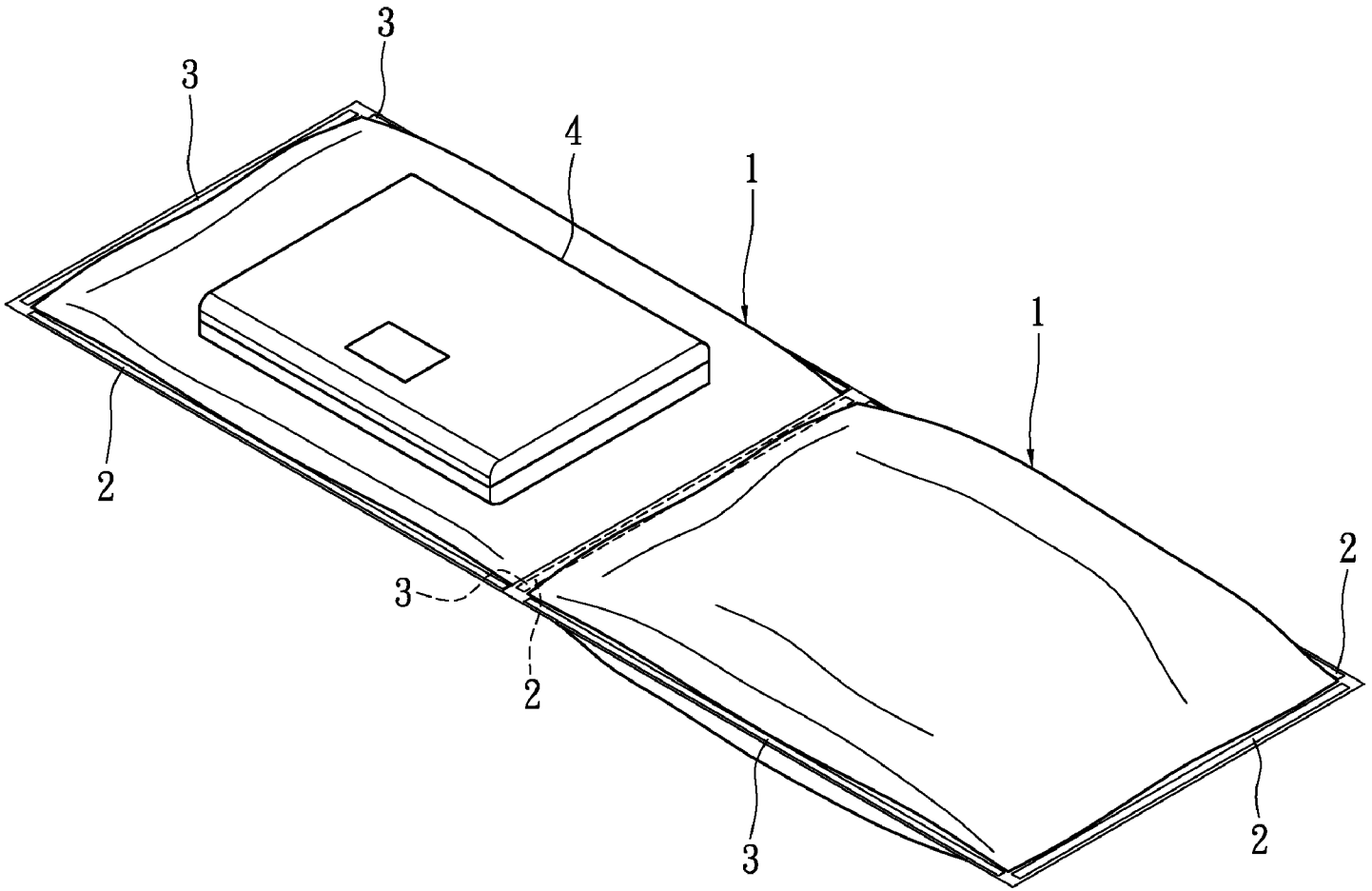
FIG. 8 is another schematic diagram of the inflatable device with air bag of the second embodiment of the present invention.

In the second embodiment, the inflatable device with air bag of the present invention uses two air bags 1 to wrap object. For example, two sides of the object 4 respectively have an air bag 1 (referring to FIG. 7). The first assembly portion 2 and the second assembly portion 3 of one of the two air bags 1 are respectively assembled with the first assembly portion 2 and the second assembly portion 3 of another air bag 1 to form an enclosed space and the object 4 is spaced in the enclosed space. The inflatable device with air bag wraps object 4 to prevent the object 4 from being impacted and achieve the waterproof effect and the moisture-proof effect. Furthermore, two air bags 1 are detachably assembled to form an air bag with larger dimension (referring to FIG. 8). That detachably assembled means the air bags 1 are enable to be disassembled. Next, the air bag 1 is folded by half to wrap the object 4. The first assembly portion 2 and the second assembly portion 3 can be Velcro, zipper, or pressed strips to achieve the same effect.

Figure 9:
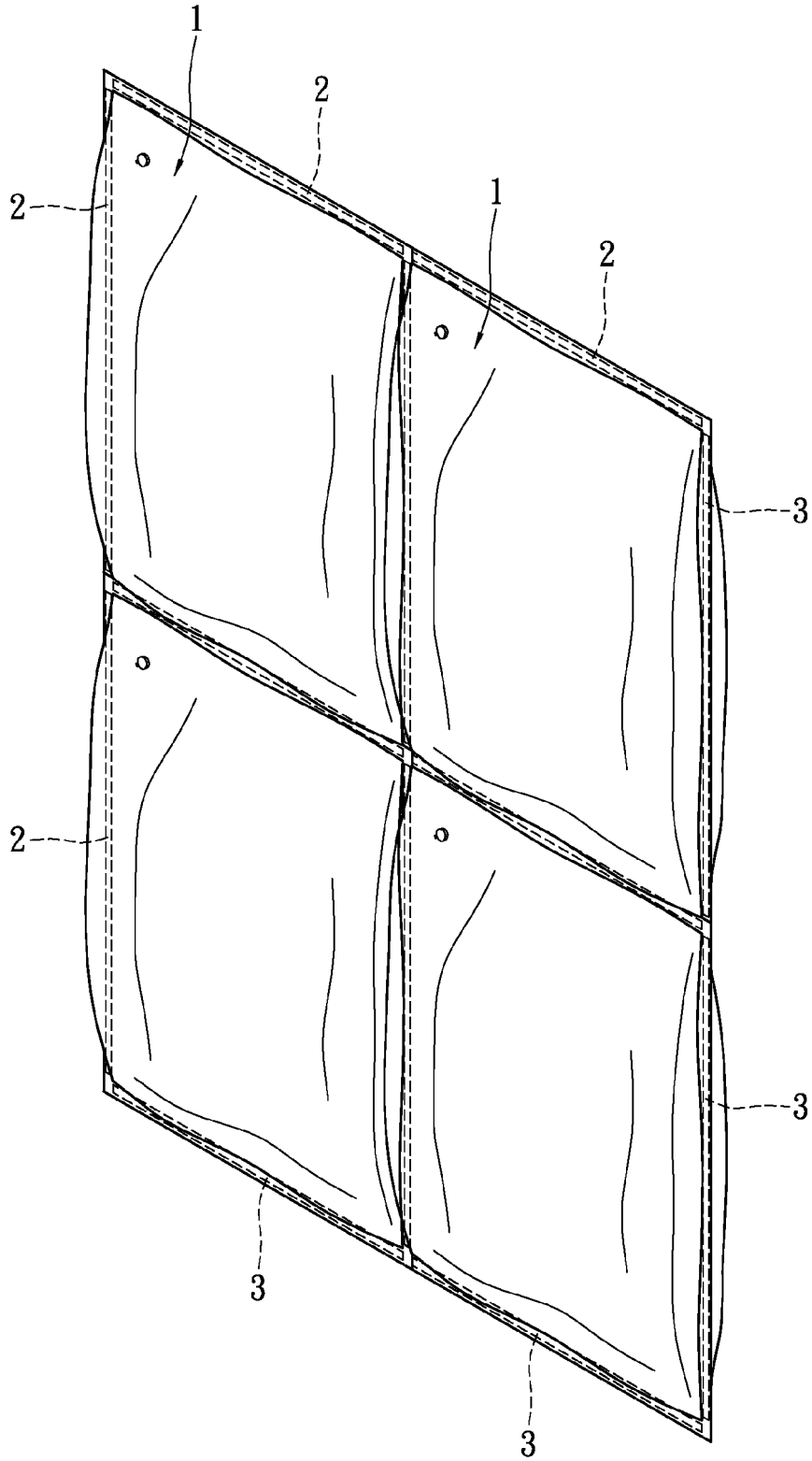
FIG. 9 is a perspective view of the assembled inflatable device with air bag of the present invention.
Figure 10:
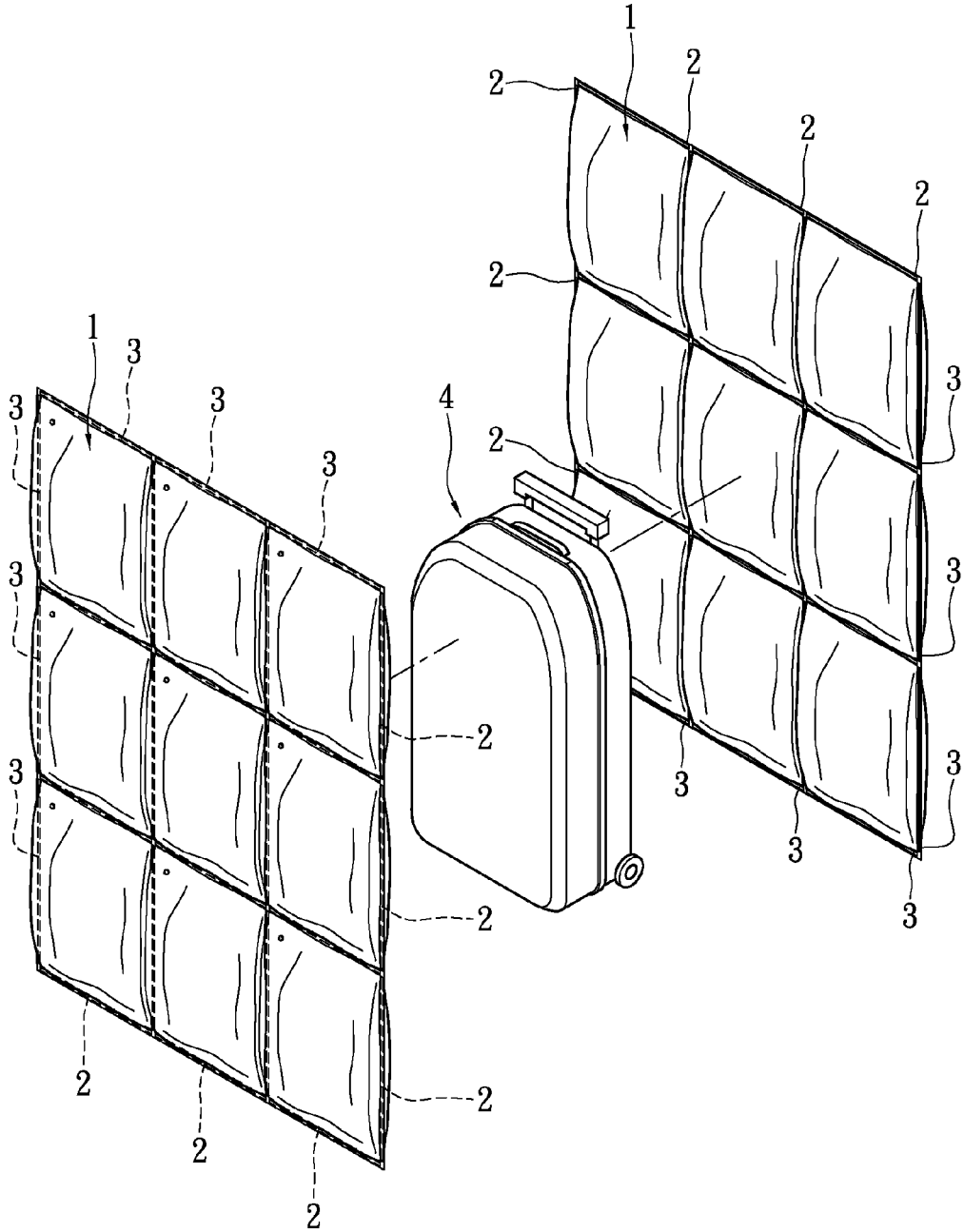
FIG. 10 is a schematic diagram of the inflatable device with air bag of the third embodiment of the present invention.

In the third embodiment, the inflatable device with air bag of the present invention uses four or more than four air bags 1 to wrap object. For example, the upper side, lower side, left side and left side of one air bag 1 are respectively assembled with one air bag 1 to form a larger air bag 1 (referring to FIGS. 9 and 10). Therefore, the inflatable device with air bag has four or more than four air bags to wrap object 4. The first assembly portion 2 and the second assembly portion 3 of one of the air bags 1 are respectively assembled with the second assembly portion 3 and the first assembly portion 2 of another air bag 1 so that the air bags 1 form an enclosed space to wrap the object to prevent the object 4 from being impacted and achieve the waterproof effect and the moisture-proof effect. The first assembly portion 2 and the second assembly portion 3 can be Velcro, zipper, or pressed strip to achieve the same effect.

Figure 11:
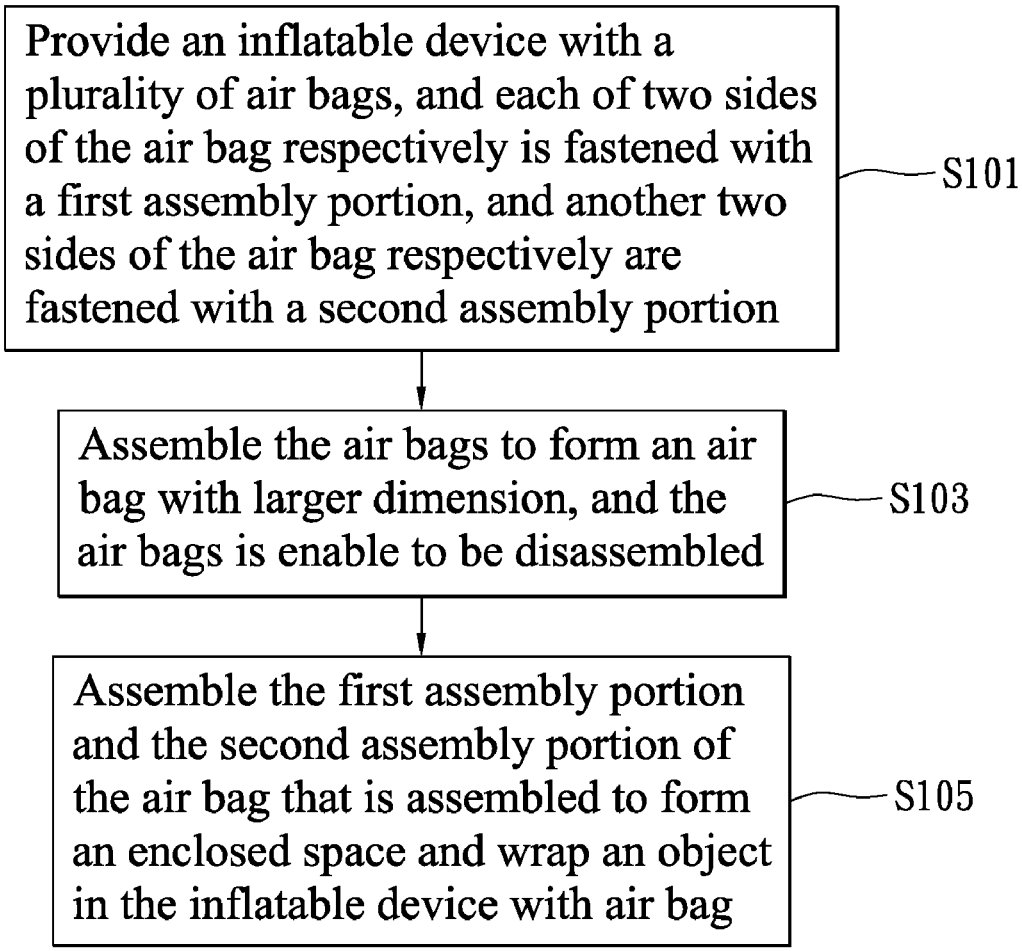
FIG. 11 is a flow chart of the packaging method by using an inflatable device with air bag of the present invention.

Reference is made to FIG. 11. The present invention also provides a packaging method by using the inflatable device with air bag and includes the following steps.

S101: An inflatable device with a plurality of air bags is provided. Each of two sides of the air bag respectively is fastened with a first assembly portion. Another two sides of the air bag respectively are fastened with a second assembly portion. The first assembly portion and the second assembly portion are assembled together by Velcro, zipper or pressed strip.

S103: The air bags are detachably assembled to form an air bag with larger dimension. The first assembly portion and the second assembly portion of the air bag are assembled with the second assembly portion and the first assembly portion of another air bag.

S105: The first assembly portion and the second assembly portion of the assembled air bag are assembled to form an enclosed space. The object is wrapped in the inflatable device with air bag to prevent the object from being impacted and achieve the waterproof effect and the moisture-proof effect.

Figure 12:
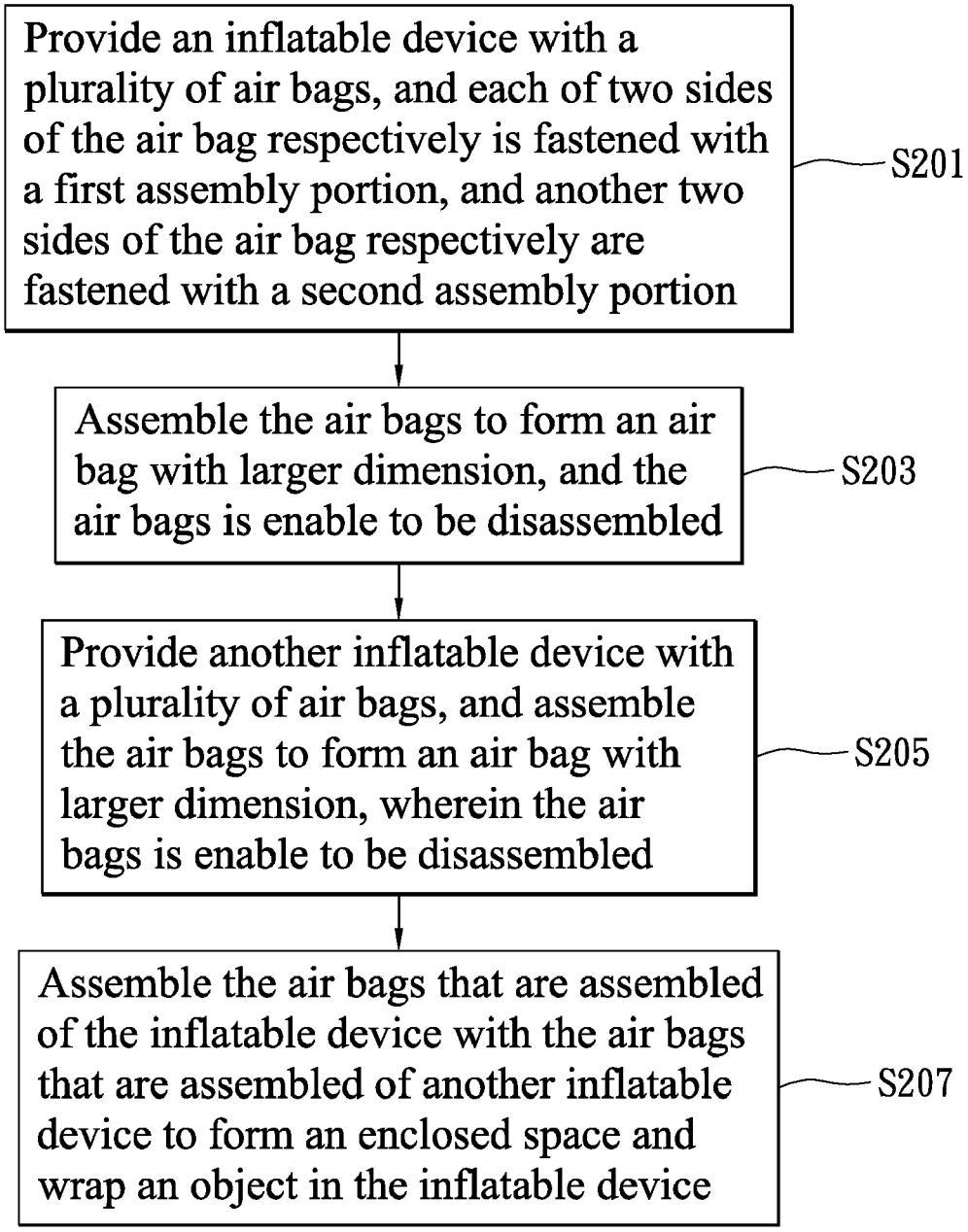
FIG. 12 is another flow chart of the packaging method by using an inflatable device with air bag of the present invention.

Reference is made to FIG. 12. The present invention also provides another packaging method by using the inflatable device with air bag and includes the following steps.

S201: An inflatable device with a plurality of air bags is provided. Each of two sides of the air bag respectively is fastened with a first assembly portion. Another two sides of the air bag respectively are fastened with a second assembly portion. The first assembly portion and the second assembly portion are assembled together by Velcro, zipper or pressed strip.

S203: The air bags are detachably assembled to form an air bag with larger dimension. The first assembly portion and the second assembly portion of the air bag are assembled with the second assembly portion and the first assembly portion of another air bag.

S205: Another inflatable device with a plurality of air bags is provided, and the air bags are detachably assembled to form an air bag with larger dimension.

S207: The assembly air bag of the inflatable device with a plurality of air bags is assembled with the assembly air bag of another inflatable device with a plurality of air bags. The two assembled inflatable devices with a plurality of air bags form an enclosed space and an object is wrapped in the inflatable device with air bag to prevent the object from being impacted and achieve the waterproof effect and the moisture-proof effect.

The present invention has the following characteristics.

1. According to dimension of the object, the first assembly portion and the second assembly portion can be serially and repeatedly assembled to expand the inflatable device with air bag with a proper dimension. The air bag that wraps an object has a good buffer effect and a shock-absorb effect to achieve the impacted-proof, waterproof, and moisture-proof effects.

2. The first assembly portion and the second assembly portion can be rapidly disassembled so that the expanded air bag can be easily received and carried. The required space is reduced The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An inflatable cushioning device, comprising:

a plurality of airbag units, each including:

a substantially flat inflatable air-pocket arranged in the central portion thereof, and a generally rectangular peripheral portion surroundingly arranged around the inflatable air-pocket, which includes a pair of oppositely arranged first assembly portions and a pair of oppositely arranged second assembly portions respectively disposed along the edges thereof, wherein the first and the second assembly portions are detachably engageable with each other;

wherein a first group of the plurality of airbag units are adjacently joined at the peripheral portions thereof in forming a generally flat first airbag assembly;

wherein a second group of the plurality of airbag units are adjacently joined at the peripheral portions thereof in forming a generally flat second airbag assembly;

wherein the first and second airbag assemblies are detachably joined at the respective outer peripherals thereof to cooperatively define an enclosed space therebetween.

2. The inflatable cushioning device as claimed in claim 1, wherein the air-pocket has a main body, an air room and an air-inlet opening, the air room is located in the main body and is separated from external environment, the air-inlet opening is located on the main body, and the air-inlet opening links the air room with the external environment.

3. The inflatable cushioning device as claimed in claim 1, wherein the first assembly portions and the second assembly portions are Velcro, zipper, or pressed strip.

4. The inflatable cushioning device as claimed in claim 1, wherein an object is placed in the enclosed space, and the inflatable cushioning device wraps the object.

5. The inflatable cushioning device as claimed in claim 4, wherein the object is cell phone, PDA, walkman, laptop or baggage.

* * * * *